US012000646B2

(12) United States Patent
Leibman et al.

(10) Patent No.: US 12,000,646 B2
(45) Date of Patent: Jun. 4, 2024

(54) REFRIGERATOR APPLIANCE WITH FLEXIBLE STORAGE CONTAINER

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Brent Alden Junge, Evansville, IN (US); Veera Venkata Anil Bhaskar Prasad Seereddy, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 162 days.

(21) Appl. No.: 17/544,156

(22) Filed: Dec. 7, 2021

(65) Prior Publication Data

US 2023/0175761 A1 Jun. 8, 2023

(51) Int. Cl.

| | |
|---|---|
| ***F25D 25/02*** | (2006.01) |
| ***F25D 23/02*** | (2006.01) |
| ***F25D 23/04*** | (2006.01) |

(52) U.S. Cl.

CPC ..... *F25D 23/04* (2013.01); *F25D 23/028* (2013.01); *F25D 25/022* (2013.01)

(58) Field of Classification Search

CPC ..... F25D 23/022; F25D 23/028; F25D 23/04; F25D 25/00; F25D 25/005; F25D 25/02; F25D 25/021

See application file for complete search history.

(56) References Cited

U.S. PATENT DOCUMENTS

| | | | | |
|---|---|---|---|---|
| 6,880,902 | B2 | 4/2005 | Zimmerman | |
| D571,614 | S * | 6/2008 | Curtin | D7/545 |
| D799,133 | S | 10/2017 | Wong | |
| D819,289 | S | 5/2018 | Umholtz | |
| D820,543 | S | 6/2018 | Huang | |
| D833,369 | S | 11/2018 | Lan | |
| D836,956 | S | 1/2019 | Tsuchiyama | |
| D843,889 | S | 3/2019 | Merrill | |
| D845,042 | S | 4/2019 | Allen | |
| D855,359 | S | 8/2019 | Boettner | |
| D870,800 | S | 10/2019 | Xu | |

(Continued)

FOREIGN PATENT DOCUMENTS

| | | |
|---|---|---|
| DE | 60225636 T2 | 4/2009 |
| DE | 10208058 B4 | 10/2018 |

(Continued)

OTHER PUBLICATIONS

CN 2903840 (English translation) (Year: 2007).*

*Primary Examiner* — Jonathan Bradford

(74) *Attorney, Agent, or Firm* — Dority & Manning, P.A.

(57) ABSTRACT

A refrigerator appliance includes a cabinet that cabinet defines a food storage chamber therein. The refrigerator appliance also includes a shelf having an upper surface and a lower surface opposite the upper surface along the vertical direction. A flexible telescopic storage container mounted to the shelf. A top flange of the flexible storage container may be flush with the upper surface of the shelf. The shelf may include an aperture extending through the shelf from the upper surface to the lower surface and the flexible telescopic storage container may be mounted to the shelf through the aperture.

18 Claims, 19 Drawing Sheets

(56) References Cited

U.S. PATENT DOCUMENTS

| | | | | |
|---|---|---|---|---|
| D869,809 | S | 12/2019 | Dardashti | |
| D877,601 | S | 3/2020 | White | |
| D878,700 | S | 3/2020 | Dardashti | |
| 2006/0137375 | A1* | 6/2006 | Lishman | F25D 23/10 62/258 |
| 2008/0149552 | A1* | 6/2008 | Murphy | A47J 47/005 210/251 |
| 2008/0230462 | A1* | 9/2008 | Curtin | A47J 43/22 210/473 |
| 2019/0368799 | A1* | 12/2019 | Tsui | B65D 15/02 |

FOREIGN PATENT DOCUMENTS

| | | | |
|---|---|---|---|
| KR | 100886123 | B1 | 2/2009 |
| WO | WO-2018224263 | A1 * | 12/2018 |

* cited by examiner

REFRIGERATOR APPLIANCE WITH FLEXIBLE STORAGE CONTAINER

FIELD OF THE INVENTION

The present subject matter relates generally to refrigerator appliances, and more particularly to refrigerator appliances having flexible storage features.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

Various food storage units, such as bins, shelves, and drawers are typically provided in the chilled chamber of the refrigerator appliance in order to promote organization of and access to the food items therein. Such storage units are commonly arranged at set distances with little, if any, freedom to adjust the positions of the storage units within the limited volume available in the chilled chamber.

Accordingly, a refrigerator with features for improved storage of food items therein, such as adjustable and/or removable storage containers provided within the refrigerator, would be useful.

BRIEF DESCRIPTION OF THE INVENTION

Aspects and advantages of the invention will be set forth in part in the following description, or may be apparent from the description, or may be learned through practice of the invention.

In an exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The refrigerator appliance also includes a shelf having an upper surface, a lower surface opposite the upper surface along the vertical direction, and an aperture extending through the shelf from the upper surface to the lower surface. The refrigerator appliance further includes a flexible telescopic storage container mounted to the shelf through the aperture.

In another exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The refrigerator appliance also includes a shelf having an upper surface and a lower surface opposite the upper surface along the vertical direction. The refrigerator appliance further includes a flexible telescopic storage container mounted to the shelf with a top flange of the flexible storage container flush with the upper surface of the shelf.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
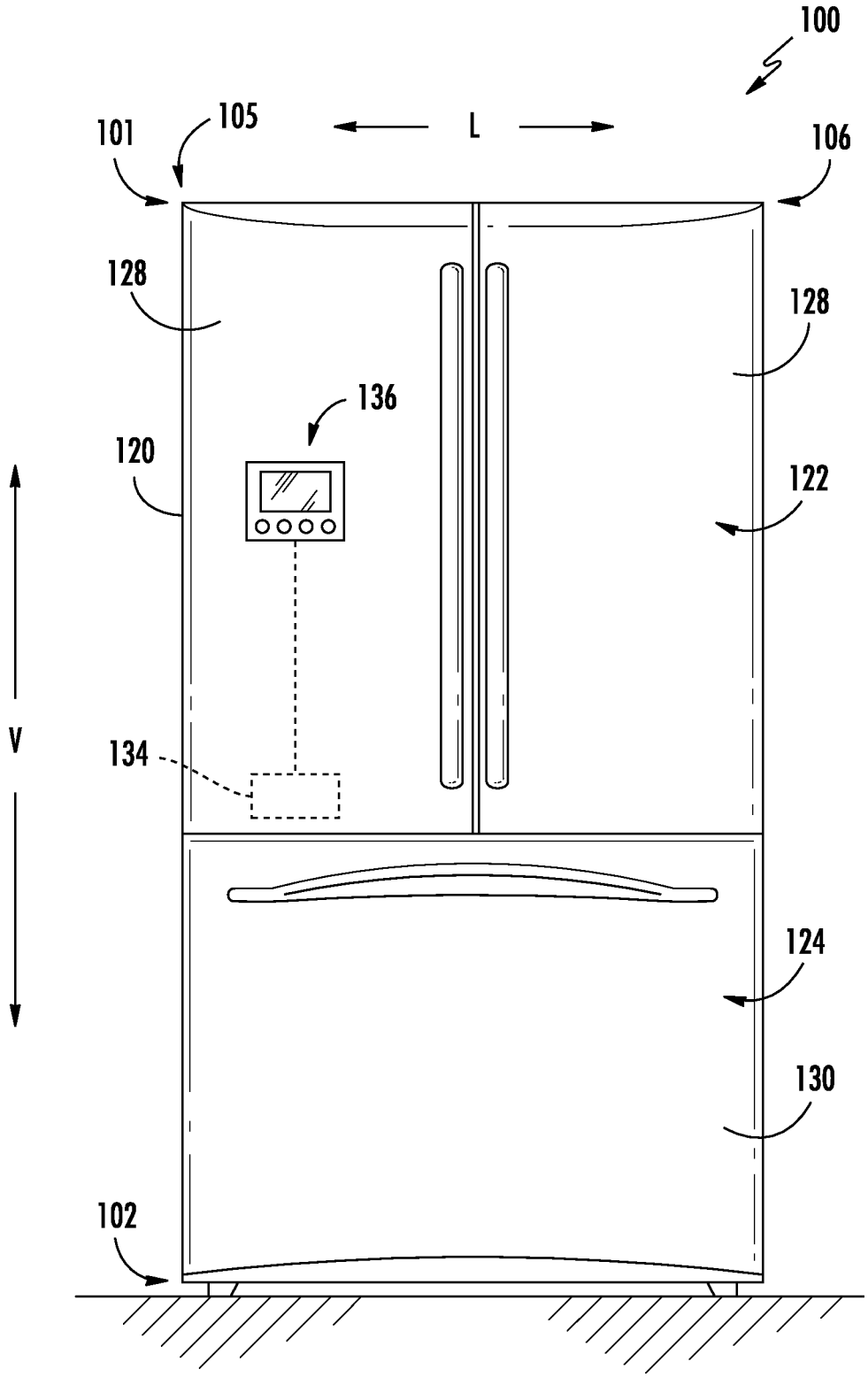
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
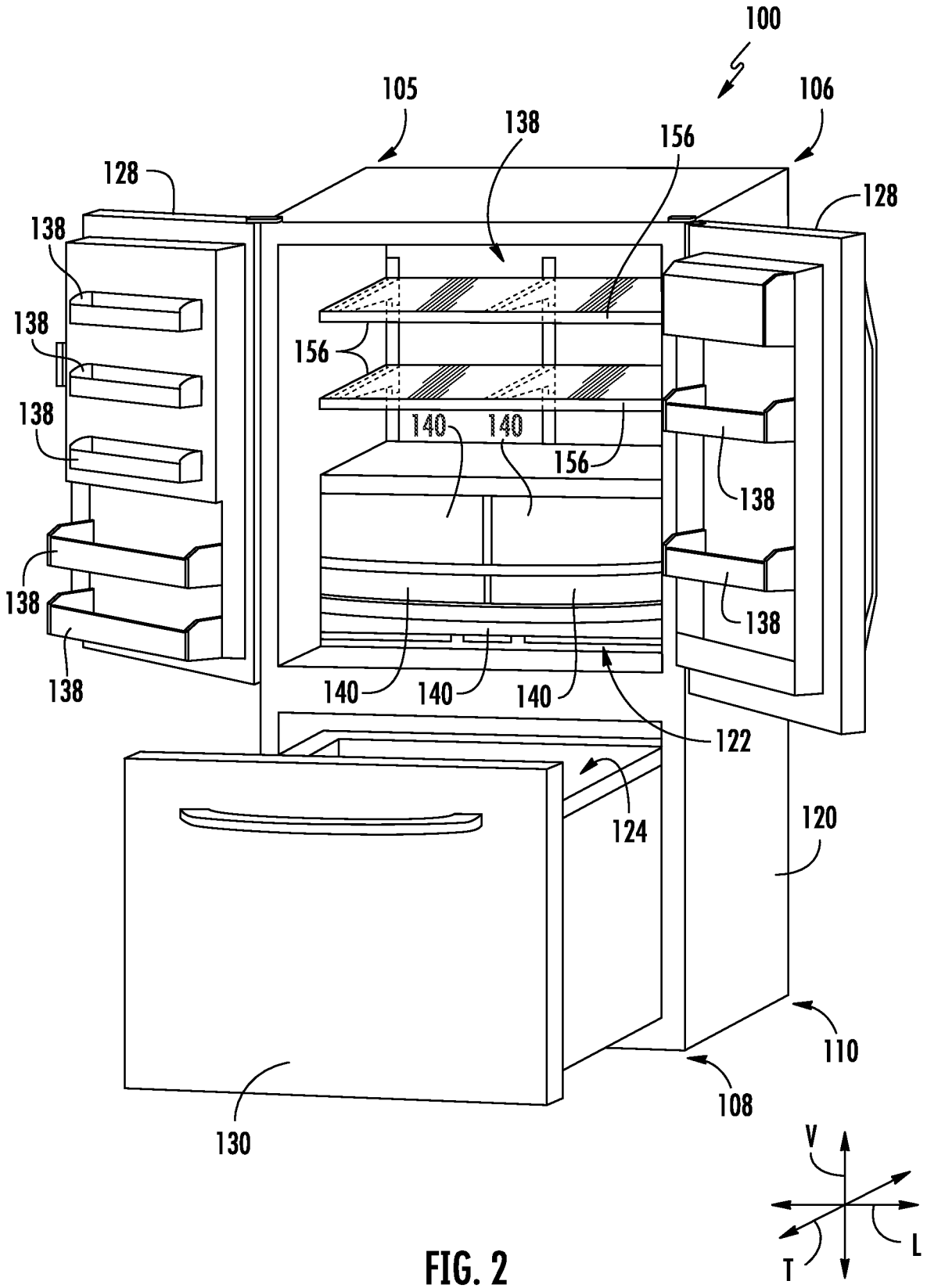
FIG. 2 provides a perspective view of the refrigerator appliance of FIG. 1.

FIG. 1 is a front view of an exemplary embodiment of a refrigerator appliance 100. FIG. 2 is a perspective view of the refrigerator appliance 100. Refrigerator appliance 100 extends between a top 101 and a bottom 102 along a vertical direction V. Refrigerator appliance 100 also extends between a first side (left side, from the perspective of a user standing in front of the refrigerator appliance 100, e.g., for accessing one or more storage compartments and/or dispensing features thereof) 105 and a second side (right side) 106 along a lateral direction L. As shown in FIG. 2, a transverse direction T may additionally be defined perpendicular to the vertical and lateral directions V and L. Refrigerator appliance 100 extends along the transverse direction T between a front portion 108 and a back portion 110.

Refrigerator appliance 100 includes a cabinet or housing 120 defining an upper fresh food chamber 122 and a lower freezer chamber or frozen food storage chamber 124 arranged below the fresh food chamber 122 along the vertical direction V. In some embodiments, an auxiliary food storage chamber (not shown) may be positioned between the fresh food storage chamber 122 and the frozen food storage chamber 124, e.g., along the vertical direction V. Because the frozen food storage chamber 124 is positioned below the fresh food storage chamber 122, refrigerator appliance 100 is generally referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or a freezer appliance as well. Consequently, the description set forth herein is for illustrative purposes only and is not intended to limit the invention in any aspect.

Refrigerator doors 128 are each rotatably hinged to an edge of housing 120 for accessing fresh food chamber 122. Each door 128 is movable, e.g., rotatable, between a closed position wherein the door 128 abuts the cabinet 120 to sealingly enclose the food storage chamber 122 and an open position which permits access to the food storage chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer slidably mounted within freezer chamber 124.

As may be seen in FIG. 2, a plurality of food storage units, such as bins 138, shelves 156, and drawers 140 are disposed within the fresh food storage chamber 122.

Operation of the refrigerator appliance 100 can be regulated by a controller 134 that is operatively coupled to a user interface panel 136. User interface panel 136 provides selections for user manipulation of the operation of refrigerator appliance 100 to modify environmental conditions therein, such as temperature selections, etc. In some embodiments, user interface panel 136 may be proximate a dispenser assembly (not shown). Panel 136 provides selections for user manipulation of the operation of refrigerator appliance 100 such as, e.g., temperature selections, selection of water or ice dispensing, etc. In response to user manipulation of the user interface panel 136, the controller 134 operates various components of the refrigerator appliance 100. Operation of the refrigerator appliance 100 can be regulated by the controller 134, e.g., controller 134 may regulate operation of various components of the refrigerator appliance 100 in response to programming and/or user manipulation of the user interface panel 136.

The controller 134 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. It should be noted that controllers 134 as disclosed herein are capable of and may be operable to perform any methods and associated method steps as disclosed herein.

The controller 134 may be positioned in a variety of locations throughout refrigerator appliance 100. In the illustrated embodiment, the controller 134 may be located within the door 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. For example, the user interface 136 may include a touchscreen providing both input and display functionality. The user interface 136 may be in communication with the controller via one or more signal lines or shared communication busses.

Using the teachings disclosed herein, one of skill in the art will understand that the present subject matter can be used with other types of refrigerators such as a refrigerator/freezer combination, side-by-side, bottom mount, compact, and any other style or model of refrigerator appliance. Accordingly, other configurations of refrigerator appliance 100 could be provided, it being understood that the configurations shown in the accompanying FIGS. and the description set forth herein are by way of example for illustrative purposes only.

Referring now to FIGS. 3 through 7, various configurations of one or more flexible telescopic storage containers 202 mounted to a shelf are illustrated. The one or more flexible telescopic storage containers 202 may be collapsible, e.g., the flexible telescopic container(s) 202 may be extendable and retractable between a collapsed position wherein the container(s) 202 define a minimal vertical profile so as to not obstruct or extend into food storage volumes below the shelf and an expanded position wherein the container(s) 202 provide an internal storage volume 204 in which various items, e.g., food items 1000, may be received. The shelf may be any suitable horizontal (e.g., perpendicular to the vertical direction V) structure within the refrigerator appliance, e.g., a floor 200 of a bin 138 on an interior surface 150 of one of the refrigerator doors 128. The shelf, e.g., the floor 200 of the bin 138, is oriented generally perpendicular to the vertical direction V. It should be understood that the floor 200 is oriented generally perpendicular to the vertical direction V in that the major dimensions, e.g., the two largest dimensions, of the floor 200 are each oriented perpendicular to the vertical direction V. For example, when the door 128 is in the closed position, the floor 200 may define a width generally along the lateral direction L and a depth generally along the transverse direction T, where each of the width and the depth of the floor 200 is several times greater, e.g., at least three times greater, than a height or thickness of the floor 200 that is defined generally along the vertical direction V. The flexible telescopic storage container 202 may be deformable generally perpendicularly to the floor 200, e.g., up and/or down generally along the vertical direction V, to move between the collapsed and expanded positions.

As will be described in more detail below, the flexible telescopic storage container 202 may include a rigid top flange 208 and a flexible body 230 coupled to and movable relative to the rigid flange 208. It is to be understood that the terms "rigid" and "flexible" are used herein relative to each other, e.g., the rigid top flange 208 is more rigid than the flexible body 230 (see, e.g., FIG. 18) and the flexible body 230 is more flexible than the rigid top flange 208. The flexible telescopic storage container 202 may further include a rigid lid 210 and the shelf, e.g., floor 200 of bin 138, is also rigid. For example, in some embodiments, the rigid elements, e.g., shelf 200, lid 210, and top flange 208 are configured to cooperatively structurally support items, e.g., one or more food items such as bottles 1002 (see, e.g., FIGS. 3 and 14), and the flexible body 230 of the flexible telescopic storage container 202 is configured to deform such that the flexible body 230 moves relative to the rigid elements in order to accommodate food items 1000 (see, e.g., FIGS. 12-14) within the flexible telescopic storage container 202.

Figure 12:
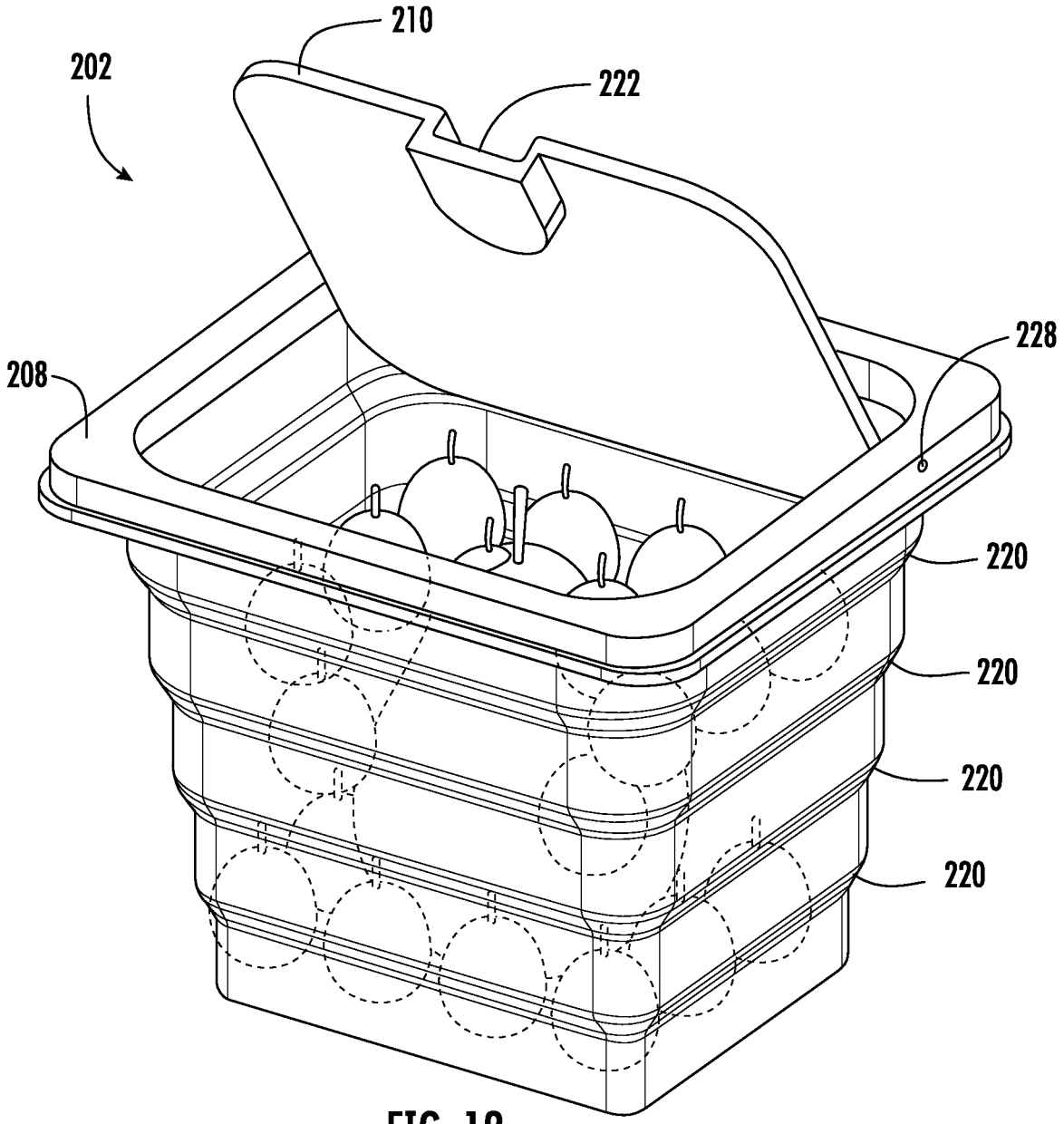
FIG. 12 provides a perspective view of a flexible telescopic storage container according to one or more exemplary embodiments of the present subject matter with a lid thereof in an open position.
Figure 13:
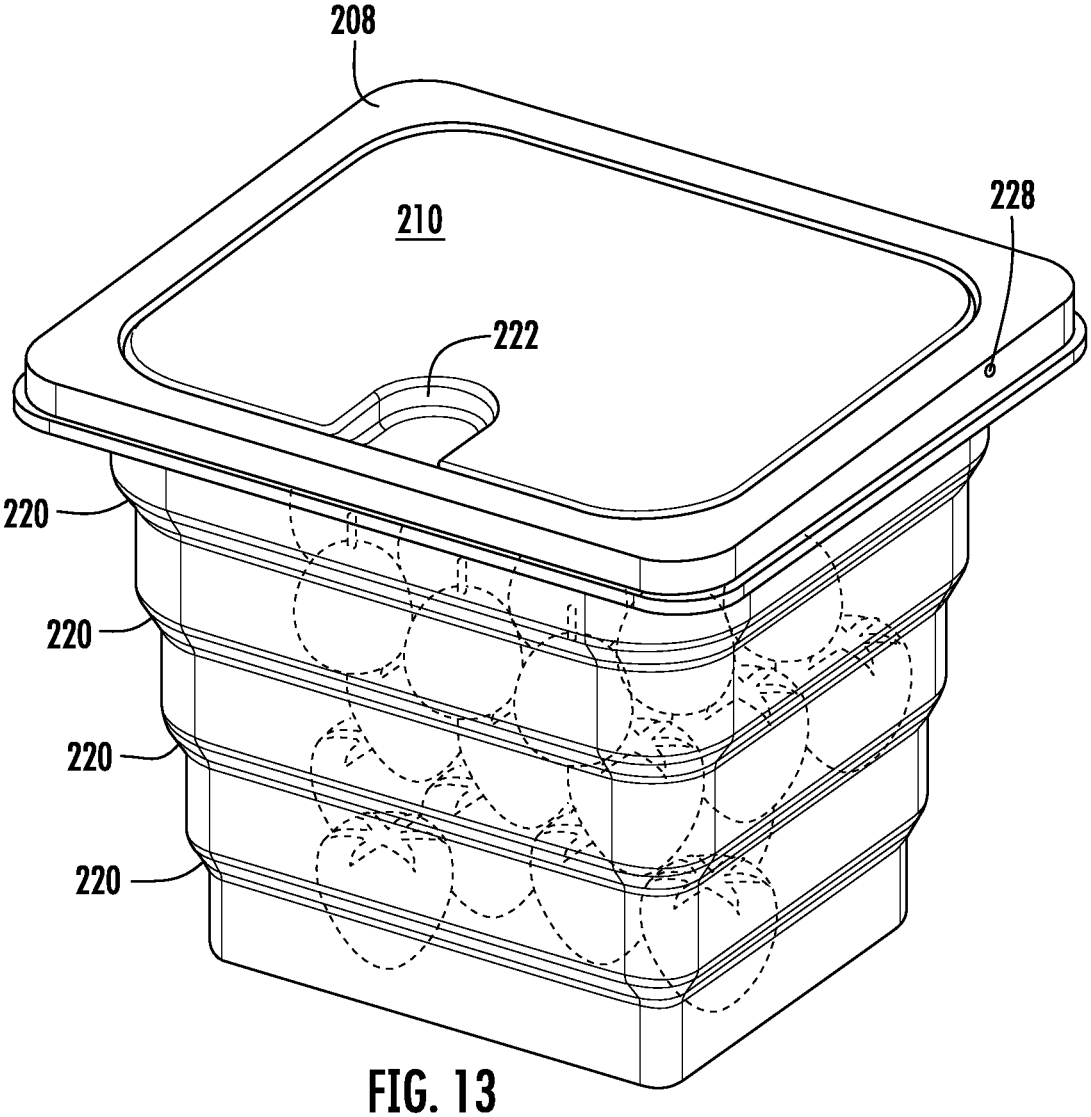
FIG. 13 provides a perspective view of the flexible telescopic storage container of FIG. 12 with the lid in a closed position.

For example, in some embodiments, the flexible telescopic storage container 202 may be deformable downwards along the vertical direction V to the expanded position, e.g., where the internal storage volume 204 defined within the flexible telescopic storage container 202 is positioned below the shelf, as illustrated in FIGS. 3 through 7. In such embodiments, the telescopic container 202 may thus be configured to receive one or more food items 1000 therein, e.g., as shown in FIGS. 12 and 13.

In some embodiments, the shelf (e.g., floor 200) and the flexible telescopic storage container 202 mounted thereto may be positioned within the food storage chamber 122, such as selectively positioned within the food storage chamber 122 when the door 128 is in the closed position. For example, as a result of the bin 138 being mounted on the interior surface 150 of the door 128, the bin 138 and the flexible telescopic storage container 202 mounted thereto may be positioned within the food storage chamber 122 when the door 128 is in the closed position.

Figure 3:
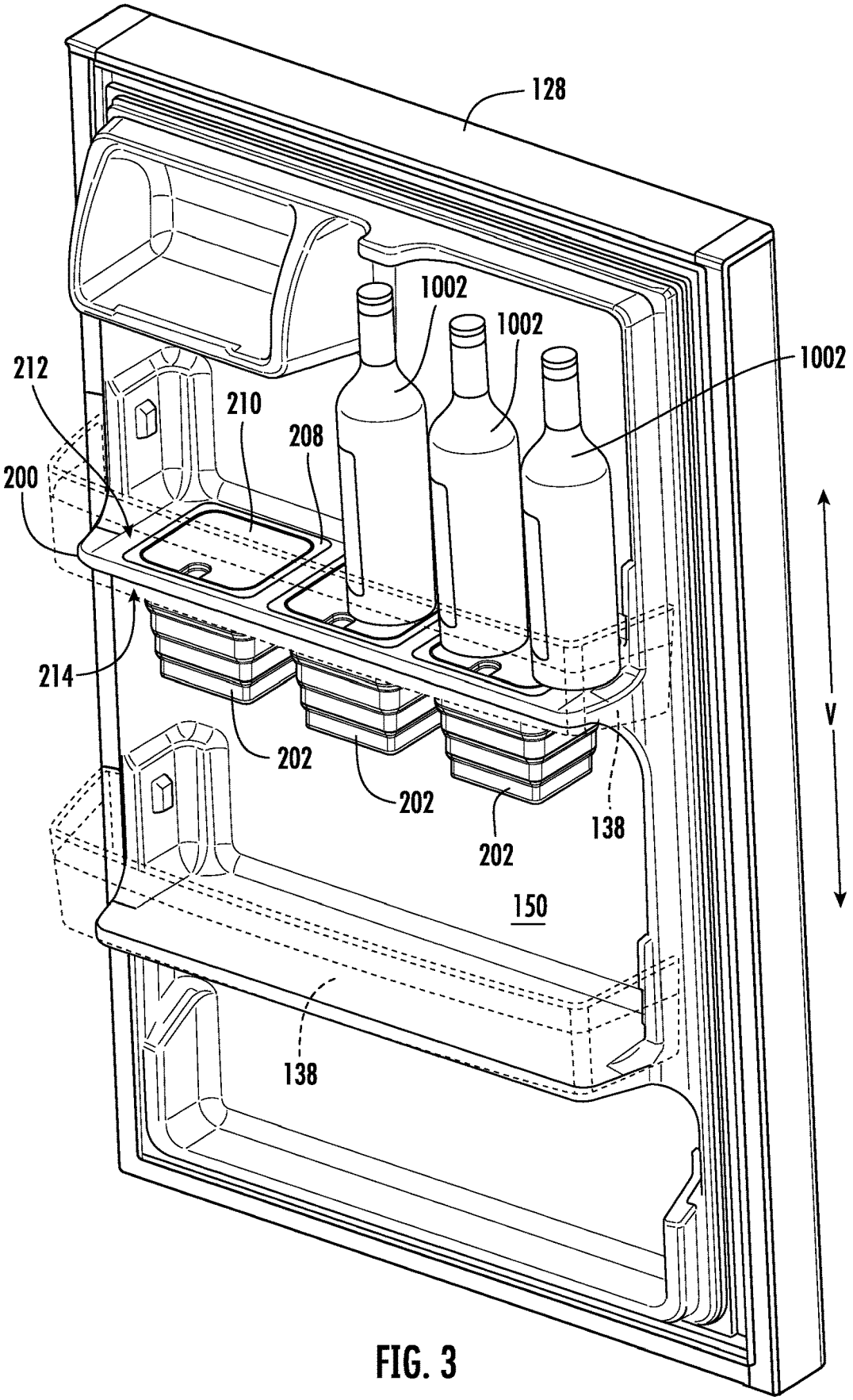
FIG. 3 provides a perspective view of an inner side of door of a refrigerator appliance according to one or more exemplary embodiments of the present subject matter.
Figure 4:
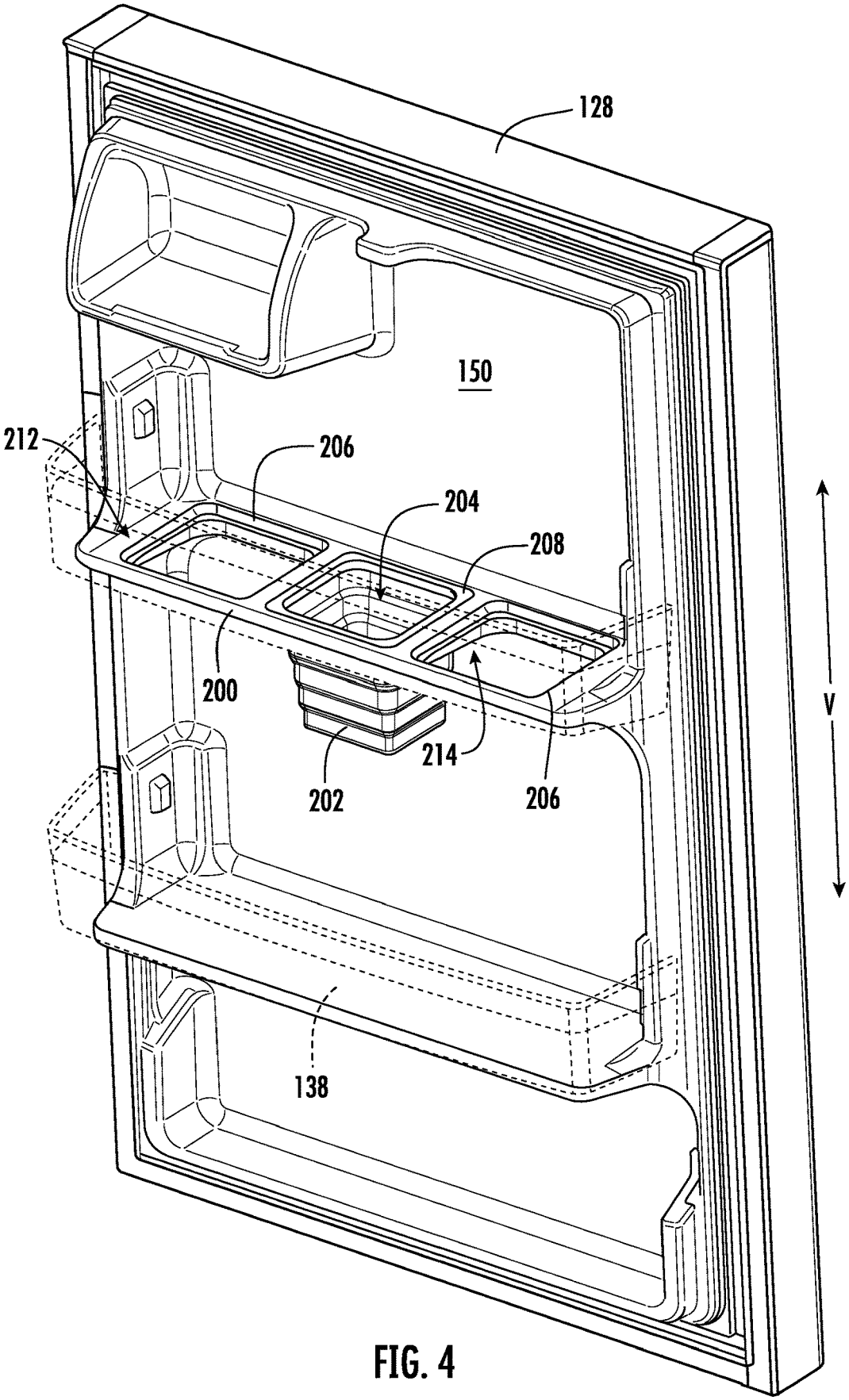
FIG. 4 provides another view of the door of FIG. 3.
Figure 5:
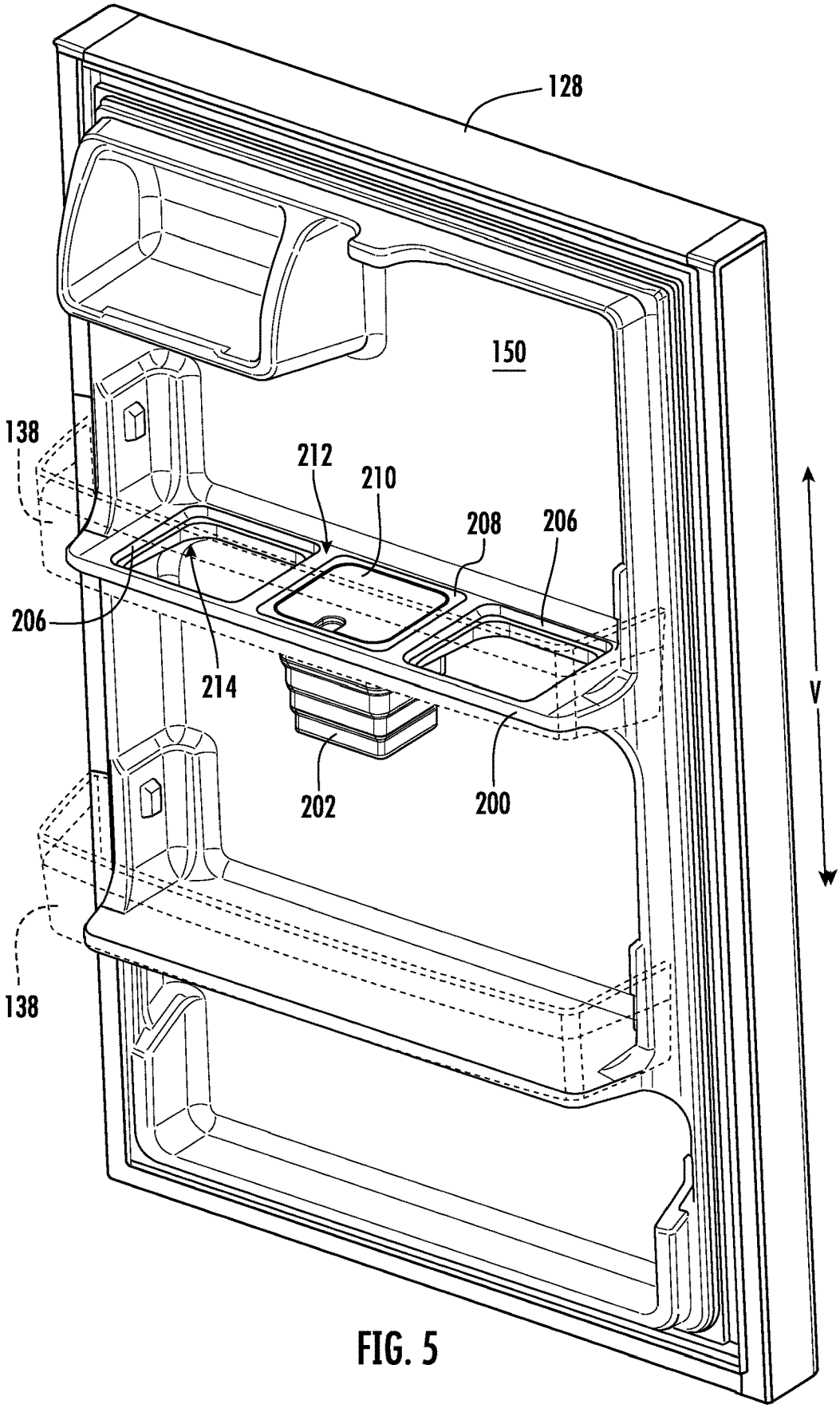
FIG. 5 provides another view of the door of FIG. 3.

In some embodiments, e.g., as may be seen in FIGS. 4 and 5, one or more apertures 206 may be defined in and through the shelf 200, e.g., the aperture 206 or each aperture 206 may extend through the shelf 200 along the vertical direction V, from an upper surface 212 of the shelf 200 to a lower surface 214 opposite the upper surface 212 along the vertical direction V. The number of apertures 206 may correspond to the number of flexible telescopic storage containers 202, e.g., in embodiments such as those illustrated in FIGS. 3-7, the shelf 200 may include three apertures 206 for receiving three flexible telescopic storage containers 202 therein. In other embodiments, two or more flexible telescopic storage containers 202 may share an aperture 206, e.g., the flexible telescopic storage containers 202 may be grouped, such as twinned. Thus, the one or more flexible telescopic storage containers 202 may each be mounted to the shelf 200 through one or more corresponding apertures 206. In particular embodiments, the flexible telescopic storage container 202 may include a top flange 208, e.g., which encompasses a perimeter of and extends outward from an uppermost edge and/or uppermost surface of the flexible telescopic storage container 202. The flexible telescopic storage container 202 may be mounted to the shelf 200 through the aperture 206 such that the top flange 208 the flexible telescopic storage container 202 is flush with an upper surface of the shelf 200.

Figure 6:
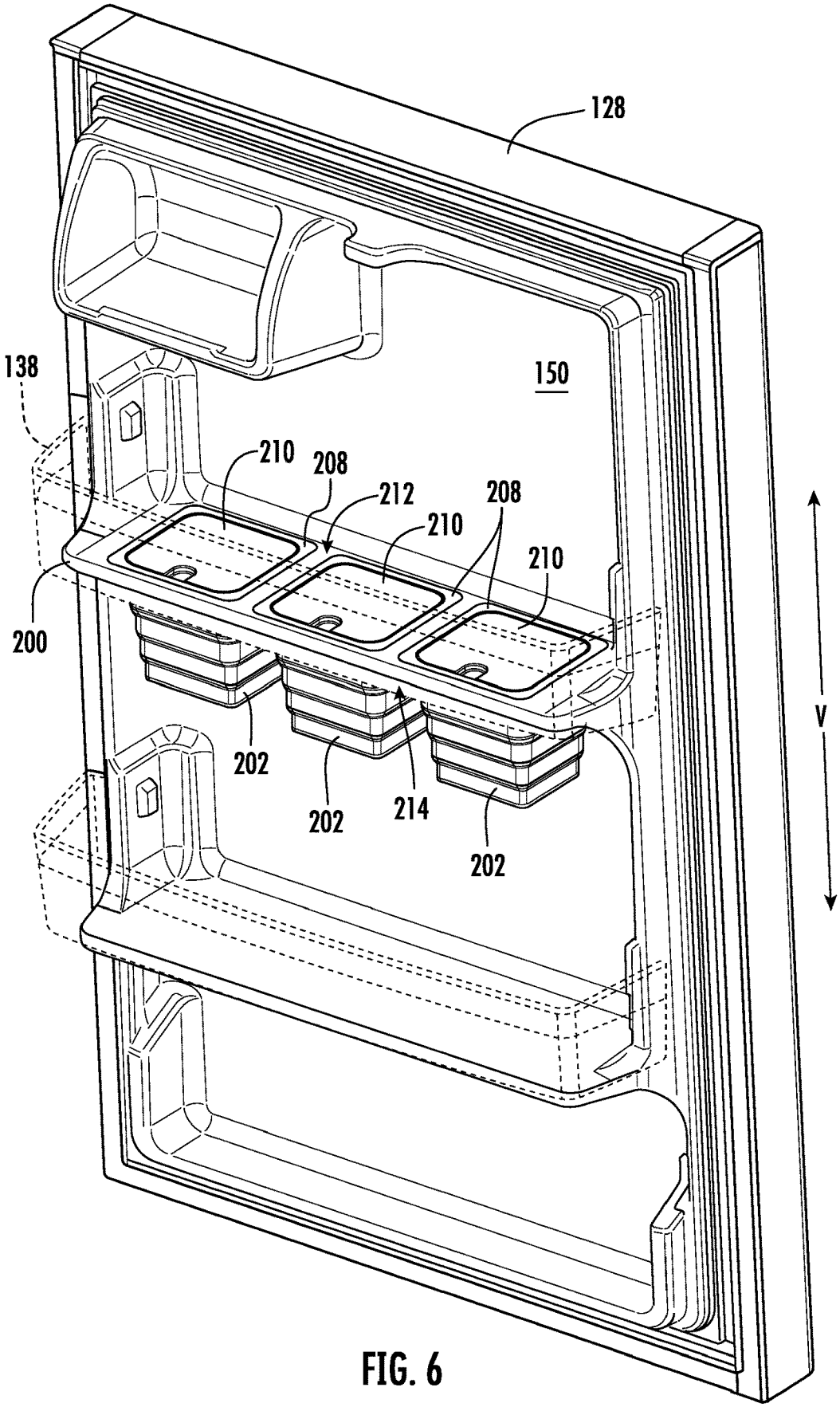
FIG. 6 provides another view of the door of FIG. 3.
Figure 7:
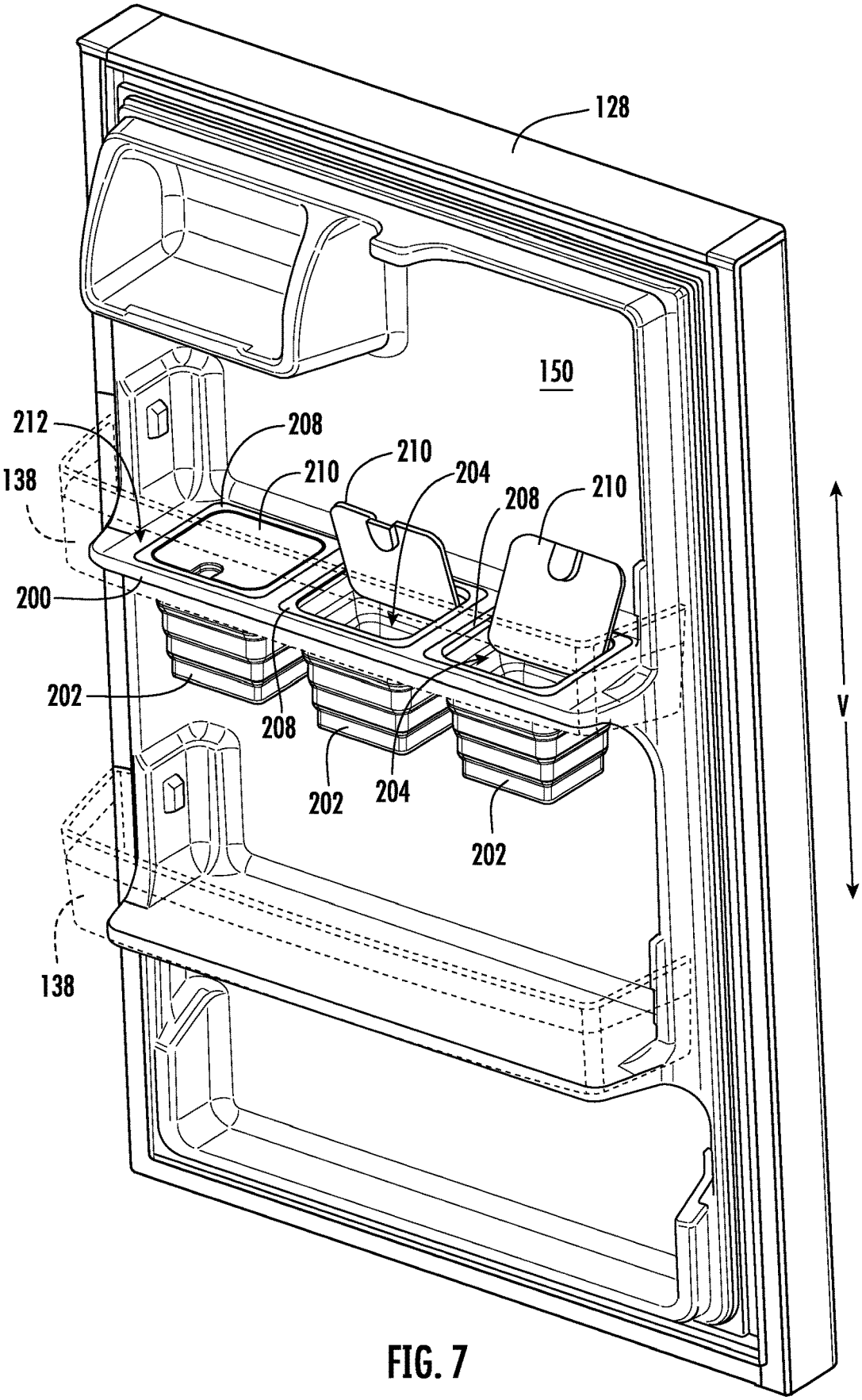
FIG. 7 provides another view of the door of FIG. 3.
Figure 14:
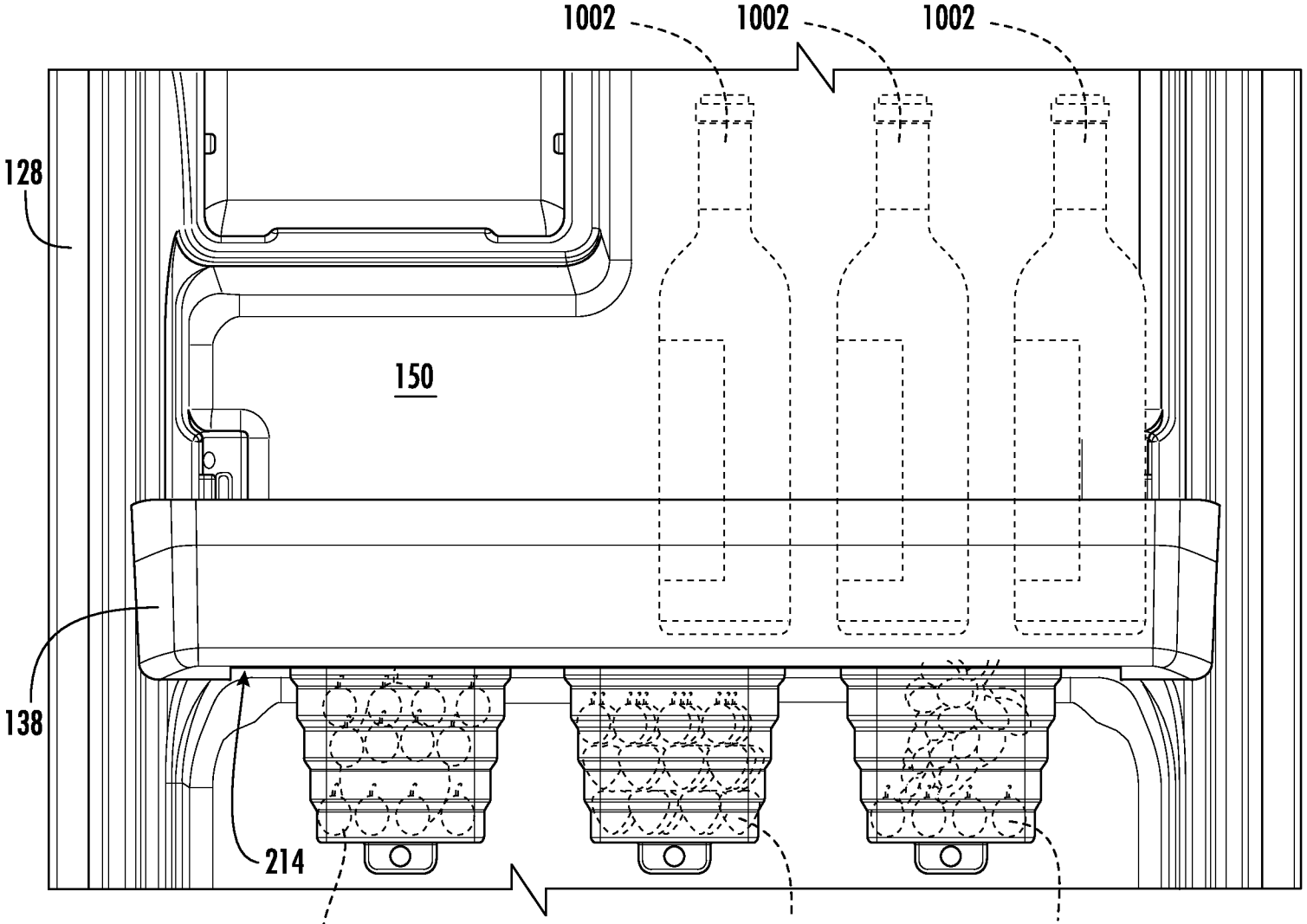
FIG. 14 provides an elevation view of a portion of an inner side of door of a refrigerator appliance according to one or more exemplary embodiments of the present subject matter.

As may be seen in particular in FIGS. 5-7, in some embodiments the flexible telescopic storage container 202 may include a lid 210. The lid 210 may be removably and rotatably coupled to the top flange 208 of the flexible telescopic storage container 202. The lid 210 may be rotatable between a closed position (e.g., FIG. 6) and an open position (e.g., two of the three flexible telescopic storage containers 202 illustrated in FIG. 7 have the lids 210 thereof in the open position). The lid 210 encloses the internal storage volume 204 of the flexible telescopic storage container 202 when in the closed position and permits access to the internal storage volume 204 of the flexible telescopic storage container 202 when in the open position. The lid 210 may snap to the top flange 208 to sealingly enclose the internal storage volume 204 when the lid 210 is in the closed position. The lid 210 may also be flush with the top flange 208 when in the closed position. Thus, when the flexible telescopic storage container 202 is mounted to the shelf 200 with the top flange 208 flush with the upper surface 212 of the shelf 200, the lid 210 is also flush with the upper surface 212 of the shelf 200. Thus, when the flexible telescopic storage container 202 is installed in, e.g., mounted to, the shelf 200, the top flange 208 and closed lid 210 of the flexible telescopic storage container 202 cooperate with the upper surface 212 of the shelf 200 to permit storage of additional food items 1002 (e.g., which may be in addition to food items 1000 (FIGS. 12 and 13) that are stored within the flexible telescopic storage container 202) on the shelf 200, e.g., as illustrated in FIGS. 3 and 14.

In some embodiments, the top flange 208 itself may comprise the lid of the flexible telescopic storage container 202, e.g., a separate rotatable lid 210 may be omitted and the top flange 208 may fully enclose the internal storage volume 204 of the flexible telescopic storage container 202 when the top flange 208 is coupled to the flexible body 230. For example, the top flange 208 (with or without a separate lid 210) may be press fit or snap fit onto the flexible body 230. In some embodiments, the top flange 208 may thereby sealingly engage the flexible body 230 and sealingly enclose the internal storage volume 204. In some embodiments, the top flange 208 (with or without a separate lid 210) may be removable from the flexible body 230 and the top flange 208 may be replaced in the aperture 206 of the shelf while removed from the rest of the flexible telescopic storage container 202, such that food items 1002 may still be stored on the shelf 200.

The flexible telescopic storage container 202 may be removably mounted to the shelf 200, e.g., may be removably mounted through the aperture 206. For example, a flexible telescopic storage container 202 removed from the shelf 200, e.g., shown in isolation, is illustrated in FIGS. 8 through 13.

Figure 8:
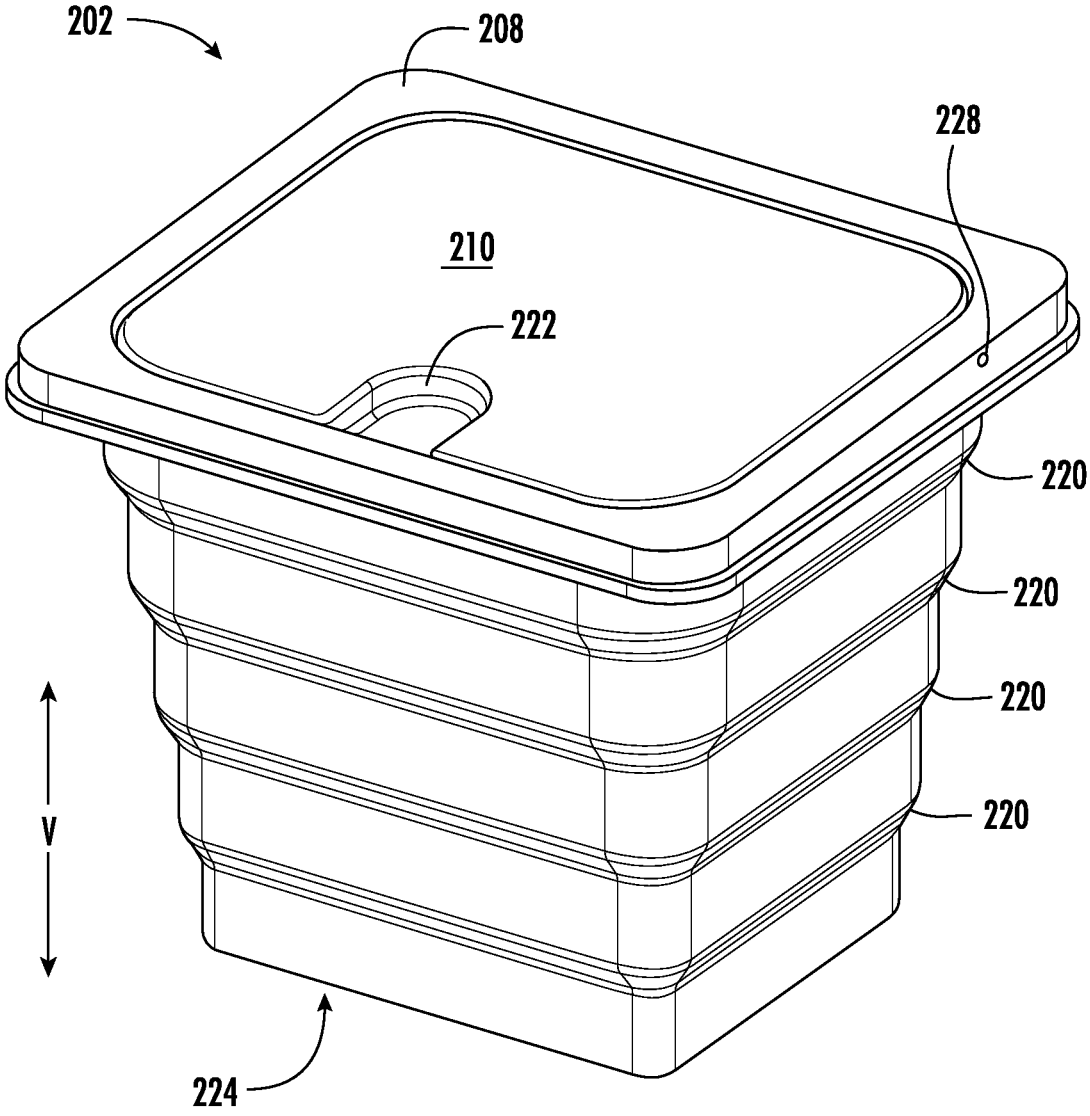
FIG. 8 provides a perspective view of a flexible telescopic storage container according to one or more exemplary embodiments of the present subject matter in an expanded position.
Figure 9:
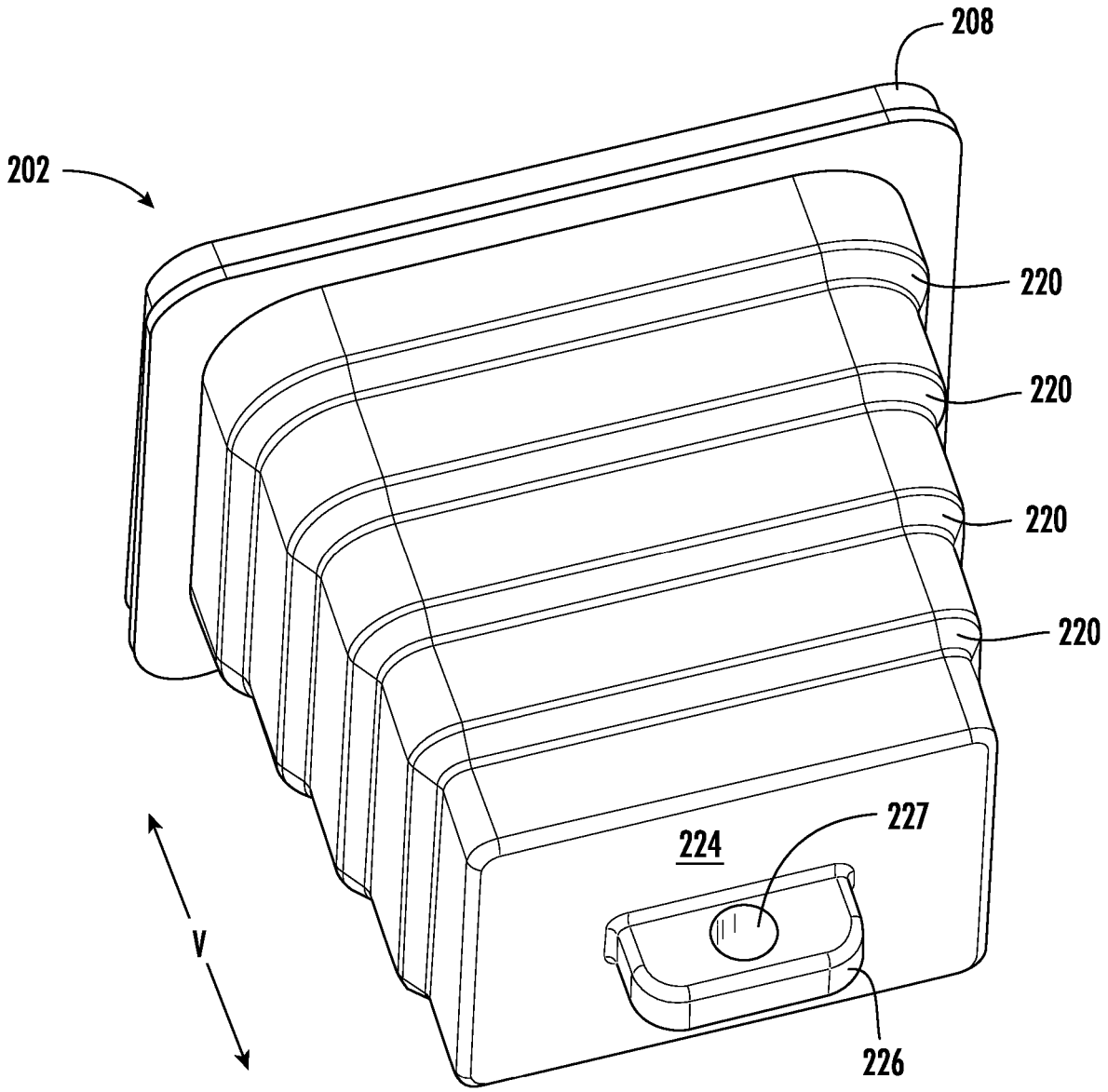
FIG. 9 provides a bottom perspective view of a flexible telescopic storage container according to one or more exemplary embodiments of the present subject matter in an expanded position.

The flexible telescopic storage container 202 is illustrated in the expanded position in FIGS. 8 and 9. The flexible telescopic storage container 202 may include a plurality of flexible joints 220. As may be seen, e.g., in FIGS. 8 and 9, the plurality of flexible joints 220 may be spaced apart along the vertical direction V when the flexible telescopic storage container 202 is in the expanded position.

Figure 10:
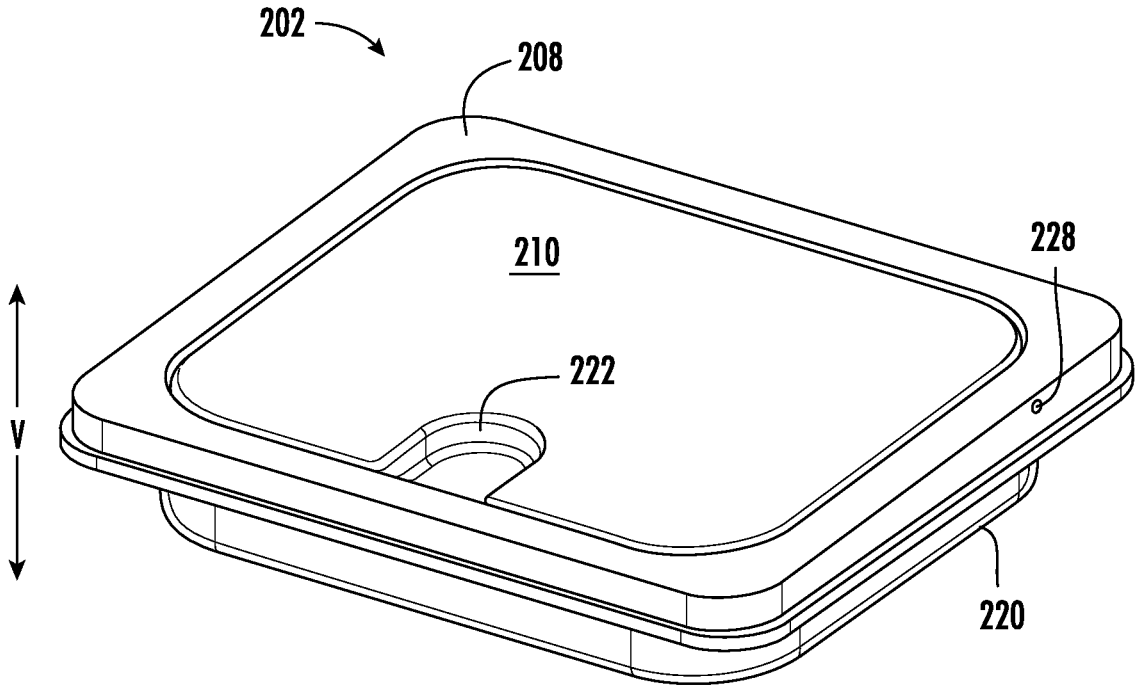
FIG. 10 provides a perspective view of a flexible telescopic storage container according to one or more exemplary embodiments of the present subject matter in a collapsed position.
Figure 11:
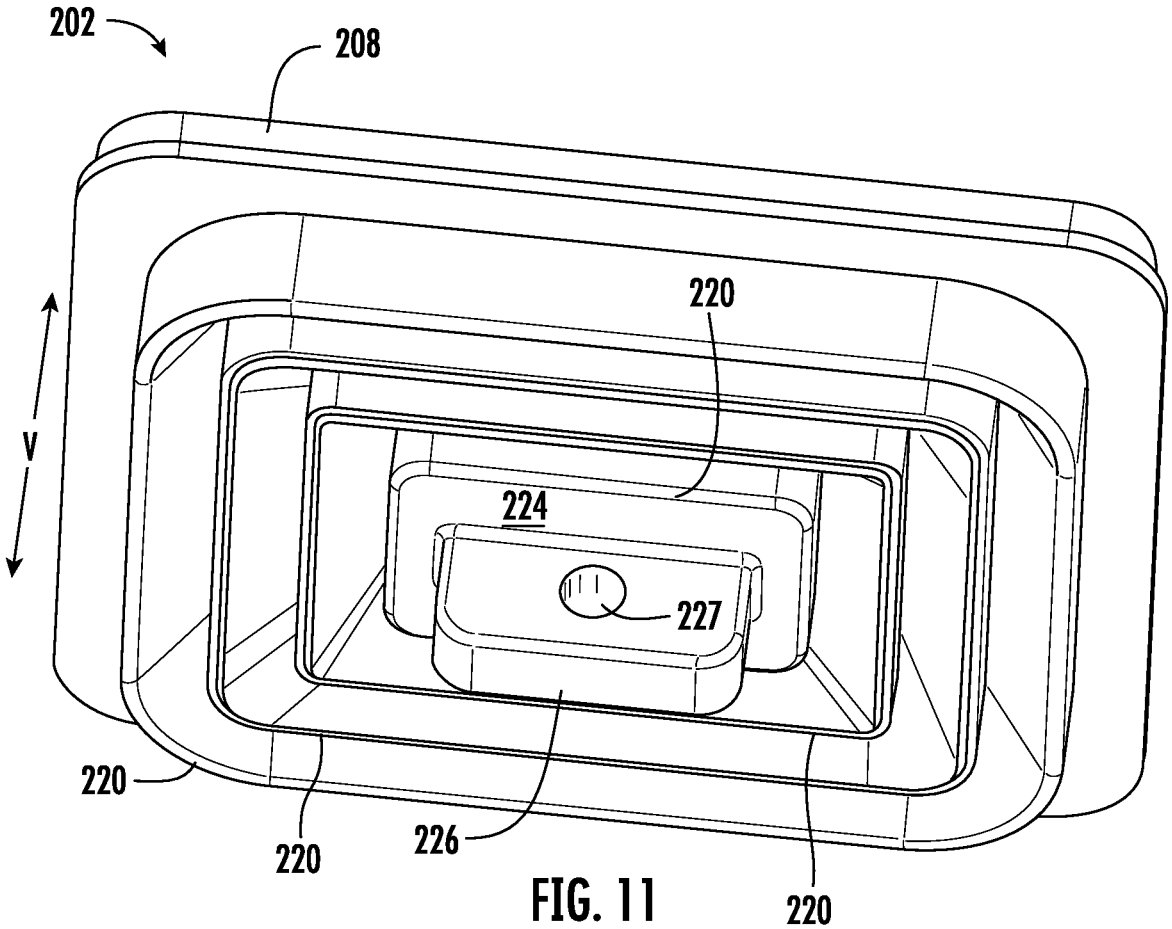
FIG. 11 provides a bottom perspective view of a flexible telescopic storage container according to one or more exemplary embodiments of the present subject matter in a collapsed position.

The flexible telescopic storage container 202 is illustrated in the collapsed position in FIGS. 10 and 11. As may be seen, e.g., in FIGS. 10 and 11, the plurality of flexible joints 220 may be aligned along the vertical direction V, e.g., may be coplanar within a plane perpendicular to the vertical direction V, whereby each flexible joint 220 occupies the same vertical position or vertical coordinate as every other flexible joint 220, when the flexible telescopic storage container 202 is in the collapsed position.

In some embodiments, e.g., as may be seen in FIGS. 8 through 11, the flexible joints 220 may be concentric and may be equally spaced apart. Further, the flexible joints 220 may decrease in size moving away from the top flange 208 of the flexible telescopic storage container 202, such as moving inward from the perimeter of the flexible telescopic storage container 202 and/or moving vertically down in the expanded position. The flexible telescopic storage container 202 may be deformable, e.g., bendable, particularly at each of the flexible joints 220.

Still referring to FIGS. 8 through 11, in some embodiments the flexible telescopic storage container 202 may optionally include a grip tab 226 thereon. The grip tab 226 may be positioned at a bottom surface 224 of the flexible telescopic storage container 202, e.g., the grip tab 226 may extend downward along the vertical direction V from the bottom surface 224 when the flexible telescopic storage container 202 is mounted to the shelf 200. The grip tab 226 may further include a detent 227 defined therein, e.g., to promote ease of grasping with a user's fingers in order to manipulate the flexible telescopic storage container 202 while moving the flexible telescopic storage container 202 between the expanded position and the collapsed position. In other embodiments, the grip tab 226 may be omitted and the bottom surface 224 may thus be generally flat (e.g., with up to and including ten degrees of curvature, convex or concave) and uninterrupted within an entire area of the bottom surface 224. Omitting the grip tab 226 and providing a flat bottom surface 224 as described may advantageously permit use of the flexible telescopic storage container 202 independent of the refrigerator appliance 100, for example, a user may store a lunch or snack, etc., in the flexible telescopic storage container 202 overnight in the refrigerator appliance 100 with the flexible telescopic storage container 202 mounted to the shelf 200, and may then remove the flexible telescopic storage container 202 from the shelf 200 to take the lunch or snack, etc. to, e.g., work or school or other similar location. In such instances, the flat bottom surface 224 promotes placing the flexible telescopic storage container 202 on a counter or table or any other suitable location or surface, e.g., at home or anywhere the user may desire to access food items 1000 outside of the refrigerator appliance 100.

As illustrated in FIGS. 12 and 13, the flexible telescopic storage container 202 may be used to store one or more food items 1000 within the internal storage volume 104 thereof. Such items 1000 may be accessible when the lid 210 is in an open position, e.g., as illustrated in FIG. 12, and may be enclosed within the flexible telescopic storage container 202 when the lid 210 is in the closed position, e.g., as illustrated in FIG. 13. As may be seen, e.g., in FIGS. 12 and 13, the lid 210 may include a finger recess 222 defined therein, e.g., to make it easier to open the lid 210.

Turning now to FIG. 14, a plurality of exemplary food items stored in or on the flexible telescopic storage containers 202 are illustrated. As mentioned above, the top flange 208 and the lid 210 (or flanges 208 and lids 210 in embodiments where more than one flexible telescopic storage container 202 is provided) may be flush with the upper surface 212 of the shelf 200, such as when the flexible telescopic storage container 202 is mounted to the shelf 200 and the lid 210 is in the closed position. Thus, additional food items 1002 may be stored on the shelf 200 (e.g., in the bin 138 in embodiments where the shelf is the floor 200 of the bin 138 as illustrated) while the flexible telescopic storage container 202 or containers 202 is or are mounted to the shelf 200, including simultaneously with food items 1000 stored in the flexible telescopic storage container 202 in and below the shelf 200.

Figure 15:
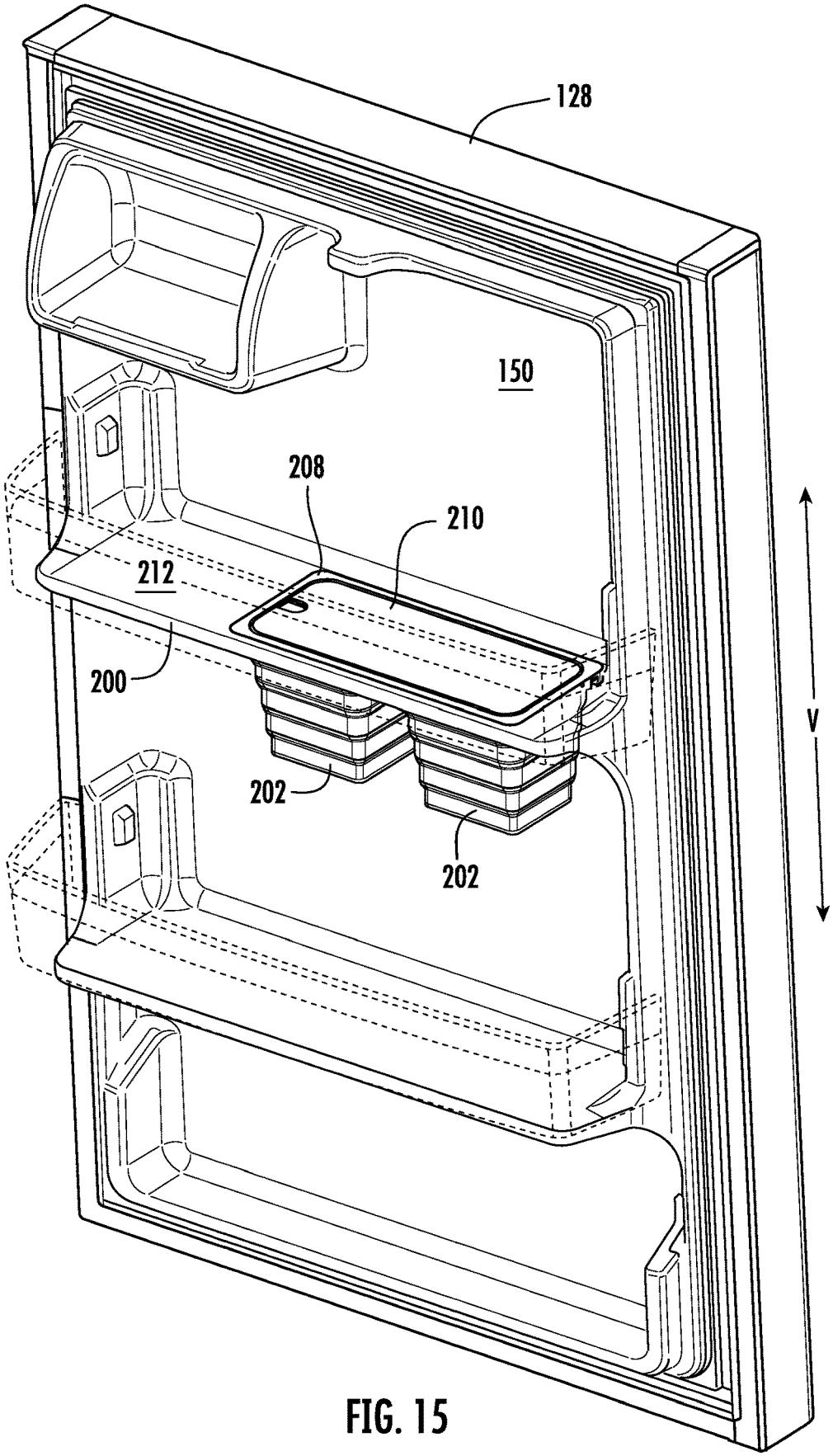
FIG. 15 provides a perspective view of an inner side of door of a refrigerator appliance according to one or more additional exemplary embodiments of the present subject matter.
Figure 16:
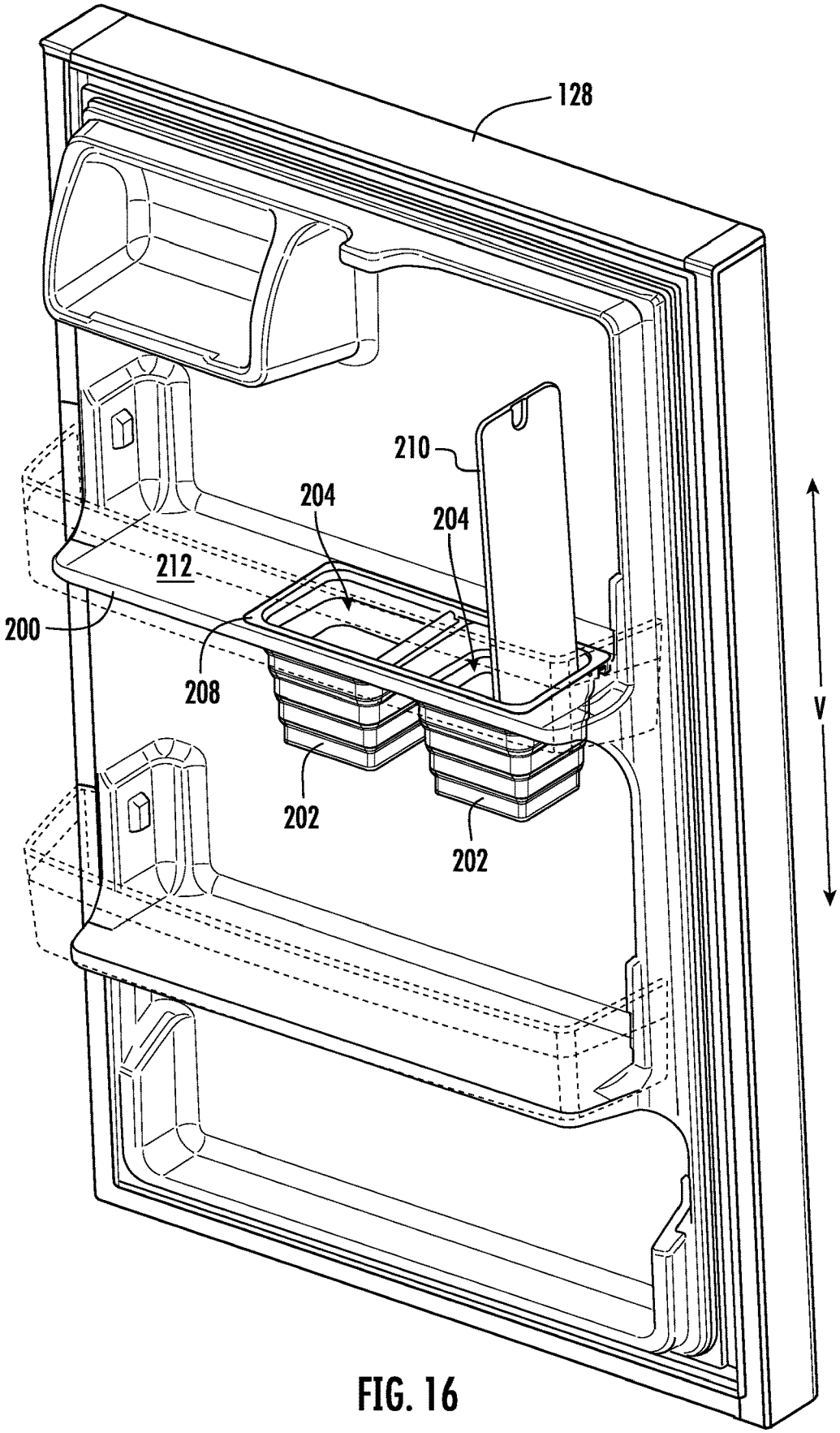
FIG. 16 provides another view of the door of FIG. 15 with a lid in an open position.
Figure 17:
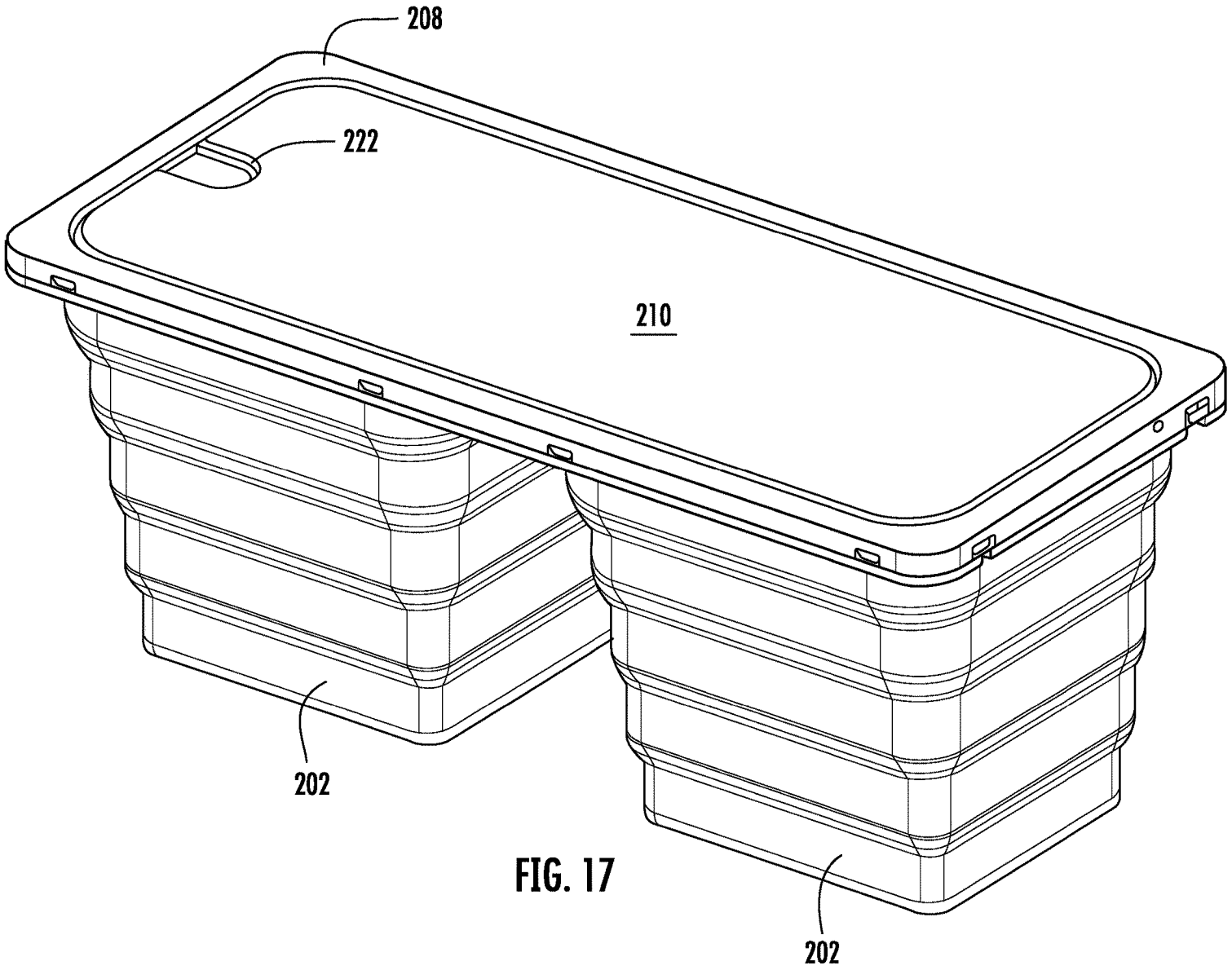
FIG. 17 provides a perspective view of a plurality of flexible telescopic storage containers according to one or more exemplary embodiments of the present subject matter.

Turning now to FIGS. 15 through 17, in some embodiments two or more flexible telescopic storage containers 202 may be grouped together. In such embodiments, the lid 210 may be rotatably coupled to a top flange 208 of one flexible telescopic storage container 202 of the plurality of flexible telescopic storage containers 202. For example, the two or more flexible telescopic storage containers 202 may have a common or shared top flange 208 and the lid 210 may be rotatably coupled, e.g., hinged, to the common top flange 208 at a short side of the top flange 208 adjacent to one of the flexible telescopic storage containers 202. As mentioned above, the lid 210 may be rotatable between a closed position and an open position, e.g., similar to the various example embodiments described above. In embodiments where a plurality of flexible telescopic storage containers 202 are grouped together, the lid 210 encloses an internal storage volume 204 of more than one flexible telescopic storage container 202 of the plurality of flexible telescopic storage containers 202, e.g., of all of the flexible telescopic storage containers 202, in the closed position. For example, two flexible telescopic storage containers 202 may be grouped or twinned together, as illustrated in FIGS. 15 through 17, with a common top flange 208 and a single lid 210 coupled to the common top flange 208, where the single lid 210 encloses both internal storage volumes 204 in the closed position. The grouped, e.g., twinned, flexible telescopic storage containers 202 may be mounted to the shelf 200 together and may be removable from the shelf 200 together, e.g., as a single coherent and cohesive unit. For example, the shelf 200 may include a single aperture 206 (see, e.g., FIGS. 4 and 5) that is configured to, e.g., sized and shaped to, receive the grouped, e.g., twinned, flexible telescopic storage containers 202 therein such that the flexible telescopic storage containers 202 may be mounted to the shelf 200 through the single aperture 206.

Figure 18:
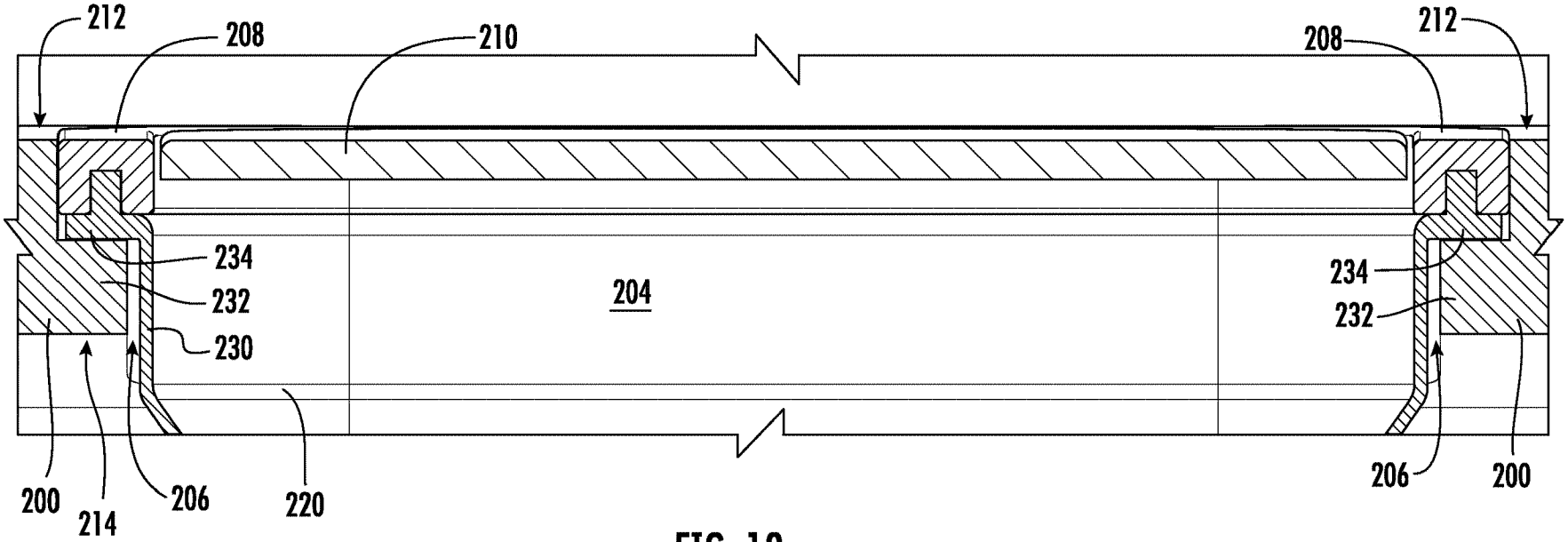
FIG. 18 provides a section view of an aperture in a shelf and a top flange of a flexible telescopic storage container mounted to the shelf through the aperture.

FIG. 18 illustrates a cross section of the shelf 200 with a flexible telescopic storage container 202 mounted thereto. The flexible telescopic storage container 202 may include a flexible body 230, e.g., in which the flexible joints 220 are defined, that is coupled to, e.g., press fit to, the top flange 208. Thus, the flexible body 230 may include a flexible material whereas the top flange 208 may include a rigid material, e.g., in contrast to the flexible material of the body 230.

Also as may be seen in FIG. 18, the aperture 206 may include a first, larger, cross sectional area in the upper surface 212 of the shelf 200 and a second, smaller, cross sectional area in the lower surface 214 of the shelf 200. Thus, a ledge 232 may be defined in the aperture 206, e.g., between the upper surface 212 and the lower surface 214. The flexible telescopic storage container 202 may be mounted to the shelf 200 through the aperture 206 such that a flange 234 of the flexible telescopic storage container 202 rests on the ledge 232 in the aperture 206. Thus, the flexible telescopic storage container 202 may be held within the aperture 206 by gravity and may be removable from the shelf 200 and the aperture 206 therein by lifting the flexible telescopic storage container 202 up and out of the aperture 206.

Figure 19:
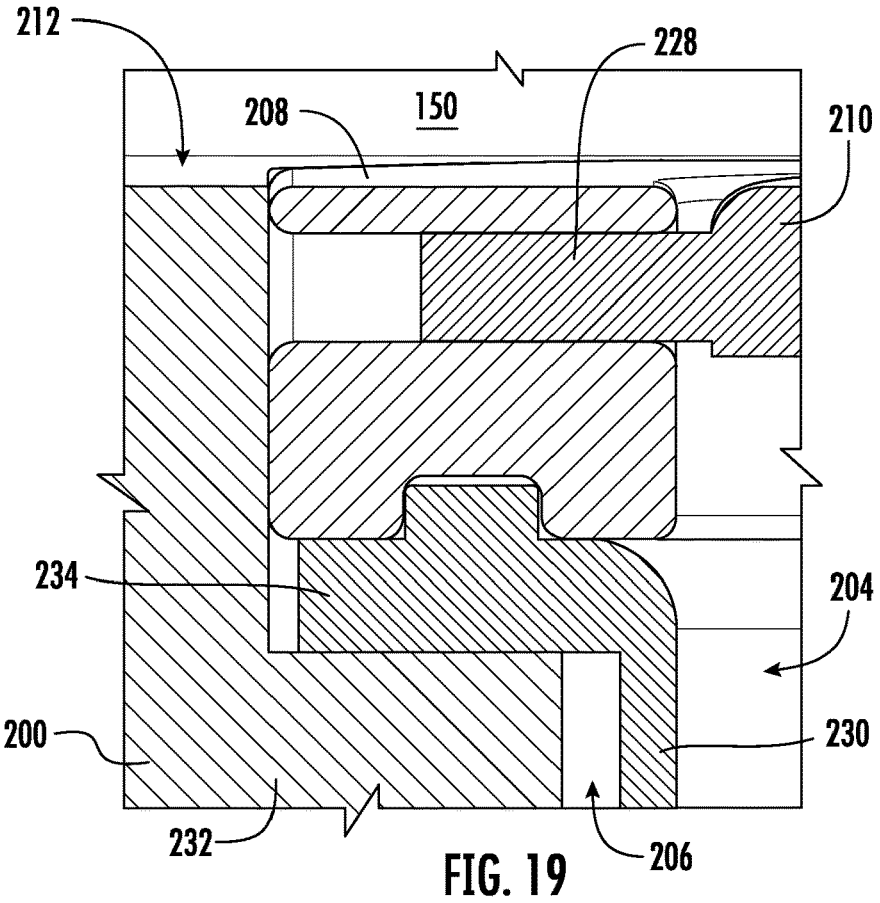
FIG. 19 provides a section view of a portion of a flexible telescopic storage container according to one or more exemplary embodiments of the present subject matter.

FIG. 19 provides an enlarged section view of the flexible telescopic storage container 202 and the shelf 200, taken at a hinge 228 of the flexible telescopic storage container 202. As mentioned above, the lid 210 may be rotatably coupled to the top flange 208, e.g., by the hinge 228.

Figure 20:
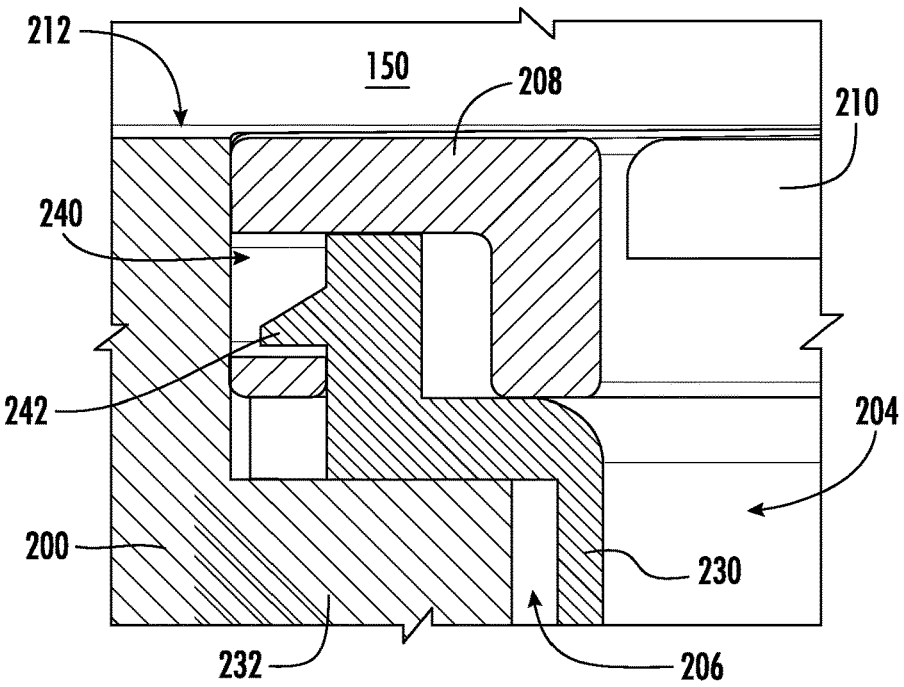
FIG. 20 provides a section view of another portion of a flexible telescopic storage container according to one or more exemplary embodiments of the present subject matter.

FIG. 20 provides an enlarged section view of the flexible telescopic storage container 202 and the shelf 200, and in particular of a connection point between the top flange 208 of the flexible telescopic storage container 202 and the flexible body 230 of the flexible telescopic storage container 202. In some embodiments, e.g., as illustrated in FIG. 20, the top flange 208 may be snap fit onto the flexible body 230. For example, the top flange 208 may include a notch 240 therein and the flexible body 230 may include a projection 242, e.g., a barb 242 as illustrated in FIG. 20, that deforms when the top flange 208 is pressed onto the flexible body 230 until the projection 242 reaches the notch 240, at which point the projection 242 snaps into the notch 240, thereby securing the top flange 208 and the flexible body 230 together. Further, the top flange 208 may be removable from the flexible body 230 by pressing inward on the projection 242 to disengage the projection 242 from the notch 240.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber;

a shelf comprising an upper surface, a lower surface opposite the upper surface along the vertical direction, and an aperture extending through the shelf from the upper surface to the lower surface; and a flexible telescopic storage container mounted to the shelf through the aperture, the flexible telescopic storage container comprising a single grip tab extending downward along the vertical direction from a bottom surface of the flexible telescopic storage container, wherein the single grip tab is the only grip tab and extends downward from a center of the bottom surface of the flexible telescopic storage container.

2. The refrigerator appliance of claim 1, wherein a top flange of the flexible telescopic storage container is flush with the upper surface of the shelf.

3. The refrigerator appliance of claim 1, wherein the flexible telescopic storage container comprises a lid rotatably coupled to a top flange of the flexible telescopic storage container, the lid rotatable between a closed position and an open position, wherein the lid of the flexible telescopic storage container is flush with the upper surface of the shelf in the closed position.

4. The refrigerator appliance of claim 1, wherein the flexible telescopic storage container is removably mounted through the aperture.

5. The refrigerator appliance of claim 1, further comprising a door rotatably mounted to the cabinet, the door movable between a closed position wherein the door abuts the cabinet to sealingly enclose the food storage chamber and an open position which permits access to the food storage chamber, wherein the shelf is a floor of a bin mounted on an interior surface of the door whereby the shelf is positioned within the food storage chamber when the door is in the closed position.

6. The refrigerator appliance of claim 1, wherein the flexible telescopic storage container is deformable and movable downward along the vertical direction from a collapsed position to an expanded position.

7. The refrigerator appliance of claim 6, wherein the flexible telescopic storage container comprises a plurality of flexible joints, the plurality of flexible joints spaced apart along the vertical direction when the flexible telescopic storage container is in the expanded position and aligned along the vertical direction when the flexible telescopic storage container is in the collapsed position.

8. The refrigerator appliance of claim 1, wherein the aperture is one of a plurality of apertures extending through the shelf from the upper surface to the lower surface, and wherein the flexible telescopic storage container is one of a plurality of flexible telescopic storage containers, each flexible telescopic storage container mounted through a respective one aperture of the plurality of apertures.

9. The refrigerator appliance of claim 8, further comprising a lid rotatably coupled to a top flange of one flexible telescopic storage container of the plurality of flexible telescopic storage containers, the lid rotatable between a closed position and an open position, wherein the lid encloses an internal storage volume of more than one flexible telescopic storage container of the plurality of flexible telescopic storage containers in the closed position.

10. A refrigerator appliance defining a vertical direction, a lateral direction, and a transverse direction, the vertical, lateral, and transverse directions being mutually perpendicular, the refrigerator appliance comprising:

a cabinet defining a food storage chamber;

a shelf comprising an upper surface and a lower surface opposite the upper surface along the vertical direction; and a flexible telescopic storage container mounted to the shelf with a top flange of the flexible telescopic storage container flush with the upper surface of the shelf, the flexible telescopic storage container comprising single grip tab extending downward along the vertical direction from a bottom surface of the flexible telescopic storage container, wherein the single grip tab is the only grip tab and extends downward from a center of the bottom surface of the flexible telescopic storage container.

11. The refrigerator appliance of claim 10, further comprising an aperture extending through the shelf from the upper surface to the lower surface, wherein the flexible telescopic storage container is mounted to the shelf through the aperture.

12. The refrigerator appliance of claim 11, wherein the flexible telescopic storage container is removably mounted through the aperture.

13. The refrigerator appliance of claim 10, wherein the flexible telescopic storage container comprises a lid rotatably coupled to the top flange of the flexible telescopic storage container, the lid rotatable between a closed position and an open position, wherein the lid of the flexible telescopic storage container is flush with the upper surface of the shelf in the closed position.

14. The refrigerator appliance of claim 10, further comprising a door rotatably mounted to the cabinet, the door movable between a closed position wherein the door abuts the cabinet to sealingly enclose the food storage chamber and an open position which permits access to the food storage chamber, wherein the shelf is a floor of a bin mounted on an interior surface of the door whereby the shelf is positioned within the food storage chamber when the door is in the closed position.

15. The refrigerator appliance of claim 10, wherein the flexible telescopic storage container is deformable and movable downward along the vertical direction from a collapsed position to an expanded position.

16. The refrigerator appliance of claim 15, wherein the flexible telescopic storage container comprises a plurality of flexible joints, the plurality of flexible joints spaced apart along the vertical direction when the flexible telescopic storage container is in the expanded position and aligned along the vertical direction when the flexible telescopic storage container is in the collapsed position.

17. The refrigerator appliance of claim 1, wherein the flexible telescopic storage container is one of a plurality of flexible telescopic storage containers, each flexible telescopic storage container mounted to the shelf with a respective top flange of each flexible storage container flush with the upper surface of the shelf.

18. The refrigerator appliance of claim 17, further comprising a lid rotatably coupled to the top flange of one flexible telescopic storage container of the plurality of flexible telescopic storage containers, the lid rotatable between a closed position and an open position, wherein the lid encloses an internal storage volume of more than one flexible telescopic storage container of the plurality of flexible telescopic storage containers in the closed position.

* * * * *